US012025134B2

(12) United States Patent
Lin et al.

(10) Patent No.: US 12,025,134 B2
(45) Date of Patent: Jul. 2, 2024

(54) MUFFLER DEVICE AND COMPRESSOR HAVING THE SAME

(71) Applicant: Danfoss (Tianjin) Ltd., Tianjin (CN)

(72) Inventors: Jiangbo Lin, Tianjin (CN); Xiaokun Ji, Tianjin (CN); Kang Zheng, Tianjin (CN); Jean-Jacques Laissus, Reyrieux (FR)

(73) Assignee: DANFOSS (TIANJIN) LTD., Tianjin (CN)

( * ) Notice: Subject to any disclaimer, the term of this patent is extended or adjusted under 35 U.S.C. 154(b) by 16 days.

(21) Appl. No.: 17/553,020

(22) Filed: Dec. 16, 2021

(65) Prior Publication Data

US 2022/0196017 A1 Jun. 23, 2022

(30) Foreign Application Priority Data

Dec. 18, 2020 (CN) ..... 202011492953.6
Dec. 18, 2020 (CN) ..... 202023085368.2

(51) Int. Cl.
*F04C 29/06* (2006.01)
*F01N 1/00* (2006.01)
*F04C 18/02* (2006.01)

(52) U.S. Cl.
CPC ..... *F04C 29/065* (2013.01); *F01N 1/006* (2013.01); *F04C 18/0215* (2013.01); *F04C 29/068* (2013.01); *F04C 2250/00* (2013.01)

(58) Field of Classification Search
CPC ..... F04C 29/06; F04C 29/065; F04C 29/066; F04C 29/068; F04C 18/0207–0292;
(Continued)

(56) References Cited

U.S. PATENT DOCUMENTS 1,844,105 A 2/1932 Schnell
2,088,576 A 8/1937 Compo
(Continued)

FOREIGN PATENT DOCUMENTS

CN 1763377 A 4/2006
CN 101560983 A 10/2009
(Continued)

OTHER PUBLICATIONS

Newman, Jay E. (2014) "Light as a Wave" from "Physics 100, Fall 2014" https://minerva.union.edu/newmanj/physics100/light%20as%20a%20wave/light_as_a_wave.htm (Year: 2014).*
(Continued)

*Primary Examiner* — Mark A Laurenzi
*Assistant Examiner* — Xiaoting Hu
(74) *Attorney, Agent, or Firm* — McCormick, Paulding & Huber PLLC

(57) ABSTRACT

The present disclosure relates to a field of scroll compressors, and more particularly to a muffler device and a compressor with the muffler device. In one embodiment, a muffler device includes a sound hood inside which an expanding cavity is defined, and a microporous plate which is disposed inside the expanding cavity and divides the expanding cavity into a first cavity body and a second cavity body, and a plurality of through holes are provided in the microporous plate such that the air flow entering the expanding cavity exits the expanding cavity after passing through the plurality of through holes of the microporous plate. The muffler device and the compressor with the muffler device provided herein may effectively reduce the noise of the scroll compressor, especially pneumatic noise.

19 Claims, 6 Drawing Sheets

(58) Field of Classification Search
CPC .... F04C 2250/00; F04C 29/061; F01N 1/003; F01N 1/006; F01N 1/02; F01N 1/023; F01N 1/026; F01N 1/04; F01N 1/06; F01N 1/00
See application file for complete search history.

(56) References Cited

U.S. PATENT DOCUMENTS

| | | | | | |
|---|---|---|---|---|---|
| 2,337,299 | A | * | 12/1943 | Noblitt | F01N 1/02 181/266 |
| 5,004,068 | A | * | 4/1991 | Sase | F01N 1/023 181/282 |
| 2001/0002980 | A1 | * | 6/2001 | Sheridan | F04C 29/065 418/181 |
| 2021/0262470 | A1 | * | 8/2021 | Wei | F04C 28/24 |

FOREIGN PATENT DOCUMENTS

| | | | | | |
|---|---|---|---|---|---|
| CN | 105201784 | A | | 12/2011 | |
| CN | 205714786 | U | | 11/2016 | |
| CN | 106337815 | A | * | 1/2017 | F04C 18/0215 |
| CN | 106677891 | A | | 5/2017 | |
| CN | 206738170 | U | | 12/2017 | |
| CN | 206845429 | U | | 1/2018 | |
| CN | 208651145 | U | | 3/2019 | |
| CN | 210068413 | U | | 2/2020 | |
| CN | 210196025 | U | | 3/2020 | |
| CN | 211666889 | U | | 10/2020 | |
| CN | 112081743 | A | | 12/2020 | |
| DE | 202014007986 | U1 | * | 2/2016 | F01N 1/026 |
| EP | 0745803 | B2 | | 4/1996 | |
| EP | 1876358 | B1 | | 9/2008 | |
| FR | 2871547 | A1 | * | 12/2005 | F02M 35/1216 |
| JP | 2005307955 | A | * | 11/2005 | |
| JP | 2017150381 | A | | 8/2017 | |
| KR | 19990008424 | A | | 3/1999 | |
| KR | 20000056524 | A | | 9/2000 | |
| KR | 2003-0044252 | A | | 6/2003 | |
| KR | 10-2004-0107087 | A | | 12/2004 | |

OTHER PUBLICATIONS

Venkataraman, D.B., & Raj, G. (2014). Experimental Investigation and Performance Evaluation of Passive Noise Control Components. International Journal of Innovative Research in Science, Engineering and Technology, 03, 16064-16071. (Year: 2014).*

Extended European Search Report for European Patent Application No. 21208034.5 dated Apr. 5, 2022.

First Examination Report for Indian Patent Application No. 202114055226 dated Jun. 29, 2022.

First European Office Action for European Patent Application No. 21208034.5 dated Oct. 12, 2023.

* cited by examiner

MUFFLER DEVICE AND COMPRESSOR HAVING THE SAME

CROSS-REFERENCE TO RELATED APPLICATION

This application claims the benefit of Chinese Patent Application Nos. 202011492953.6 and 202023085368.2 both filed on Dec. 18, 2020 in the China National Intellectual Property Administration (CNIPA), the whole disclosure of each is incorporated herein by reference.

BACKGROUND OF THE INVENTION

Technical Field

The present disclosure relates to the field of compressors, and more particularly to a muffler device and a compressor having the muffler device.

Background

With the increasingly requirements for noise reduction, the noise of the compressor needs to be improved more and more.

Currently, for low frequency noise, a common solution is to avoid resonance and reduce vibration by structural improvement, which may effectively reduce low frequency noise. However, the low frequency noise contributes a little to overall noise values. For medium and high frequency noises, such as aerodynamic noise, a common solution is to apply a sound hood, which may form a closed space around the compressor, thereby minimizing outward radiation of compressor noise. However, a closed space may cause the compressor's temperature to be increased, thereby adversely affecting the performance of the compressor, furthermore, increasing of the temperature will further facilitate a fire risk to the sound hood. In addition, the current sound hood is generally costly.

SUMMARY

The present disclosure is intended to overcome or alleviate at least one or more technical problems or defects presented in the prior art.

Therefore, at least one object of the present disclosure is to provide a muffler device for a compressor, which is able to effectively reduce the noise, especially aerodynamic noise, of the compressor.

According to an aspect of the present disclosure, there is provided a muffler device including:

- a sound hood inside which an expanding cavity is defined, and
- a microporous plate which is disposed inside the expanding cavity and divides the expanding cavity into a first cavity body and a second cavity body, and a plurality of through holes are provided in the microporous plate such that the air flow entering the expanding cavity exits the expanding cavity after passing through the through holes of the microporous plate.

Preferably, the sound hood includes an acoustic wave inlet and an acoustic wave outlet, the acoustic wave inlet and the acoustic wave outlet being communicated via the expanding cavity.

In an embodiment, the microporous plate is in a form of a flat plate; the first cavity body is directly in communication with the acoustic wave inlet, and the second cavity body is directly in communication with the acoustic wave outlet; and the first cavity body and the second cavity body are in communication via the through holes of the microporous plate.

In another embodiment, the microporous plate is in a shape of a truncated cone; and the first cavity body is directly in communication with the acoustic wave inlet and the acoustic wave outlet, and the second cavity body is in communication with the first cavity body via the through holes of the microporous plate.

In yet another embodiment, the muffler device further includes: at least one partition plate; wherein the second cavity body is divided into at least two second sub-cavity bodies by the at least one partition plate.

In yet still another embodiment, an outer wall of the sound hood is formed with one or more openings, the second sub-cavity bodies are in communication with an outside of the sound hood via the one or more openings.

Preferably, the plurality of through holes of the microporous plate are distributed in an array, and each through hole is a circular hole with a diameter of 0.5 mm to 3 mm.

Preferably, the sound hood is in a shape of a hollow cylinder, and the acoustic wave inlet and the acoustic wave outlet are respectively formed on two end surfaces of the sound hood in the shape of the hollow cylinder, respectively.

Preferably, the sound hood further includes a flange formed at the acoustic wave inlet.

According to another aspect of the present disclosure, there is provided a compressor, including:

- a housing;
- a compression assembly provided inside the housing;
- an air inlet and an exhaust port provided in the housing; and
- the muffler device of any one of above embodiments mounted at the exhaust port.

The muffler device provided by the present disclosure may be applied to, for example, an exhaust port of the compressor, in which an incident acoustic wave may be constantly refracted and/or reflected in the expanding cavity, so that the energy of the acoustic wave is substantially weakened. The incident acoustic wave and the reflected acoustic wave may cancel each other out especially when the phase difference between the incident acoustic wave and the reflected acoustic wave is 180 degree; at the same time, the microporous plate may increase the acoustic resistance of incident acoustic waves and/or reflected acoustic waves, thereby further weakening the energy of the acoustic wave, which further reduces the pneumatic noise. In addition, the muffler device provided by the present disclosure is simple in structure, and has a good sound reducing efficiency and a low cost. Further, the muffler device provided by the present disclosure may be applied to all types of compressors, such as a scroll compressor.

Other objects that may be implemented in the present disclosure and other technical effects that may be taken will be described in conjunction with the description of the specific embodiments in the following detailed description.

BRIEF DESCRIPTION OF THE DRAWINGS

In order to make the above and other objects, features and advantages of the present disclosure more obvious, the present disclosure will be further described below with reference to the accompanying drawings and specific embodiments.

DETAILED DESCRIPTION

Figure 1:
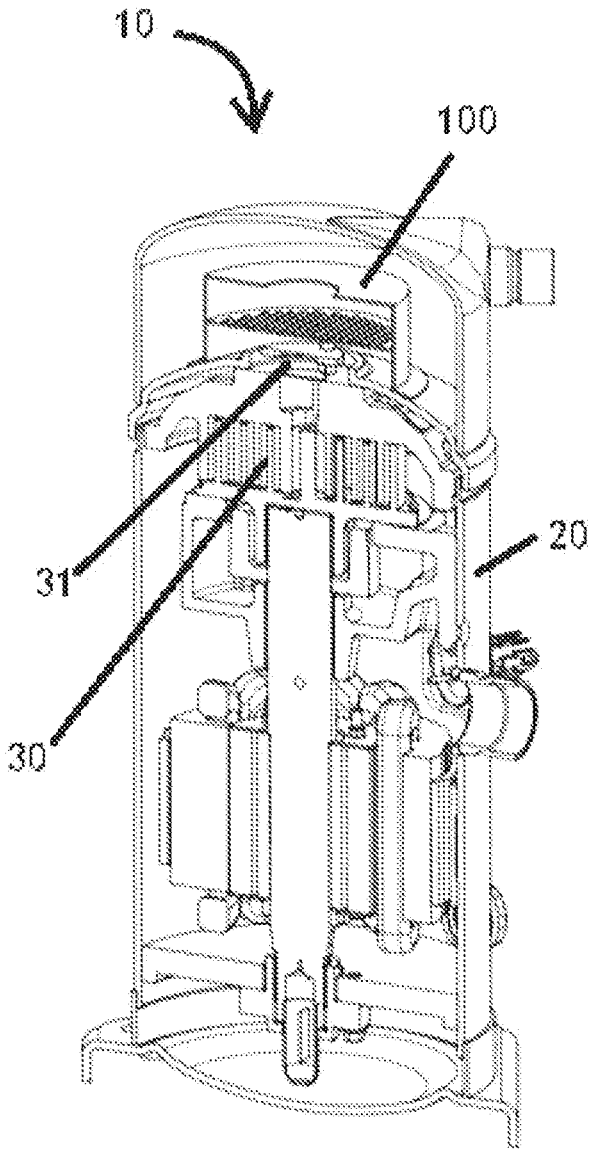
FIG. 1 is a cross-sectional structure schematic view of a muffler device according to the present disclosure applied in a compressor.

Specific embodiments of the present disclosure will be described in detail below, and examples of the specific embodiments are shown in the drawings in which the same reference numerals indicate identical or similar elements. The specific embodiments described below are merely exemplary, which is intended to explain the present disclosure without limiting the present disclosure.

Embodiments of the present disclosure relate to the field of compressors, and more particularly to a muffler device for a compressor.

FIG. 1 is a cross-sectional structure schematic view of a muffler device according to the present disclosure applied in a compressor. As shown in FIG. 1, the compressor 10 includes a housing 20, a compression assembly 30 disposed within the housing 20, and an exhaust port disposed above the compression assembly 30 and a muffler device 100. The muffler device 100 is provided at the exhaust port 31 to perform a noise reduction processing on a high-speed air flow from the exhaust port 31. In one embodiment, the compressor 10 may be a scroll compressor, and thus the compression assembly 30 is composed of a static scroll and a movable scroll. It should be noted that the muffler device according to the present disclosure may be applied not only to the scroll compressor, but also may be applied to any type of compressor with the above structure, as long as the exhaust port of the compressor can be adapted to the muffler device of the present disclosure.

According to the inventive concept of the present disclosure, there is provided a muffler device including a sound hood and a microporous plate. An expanding cavity is defined inside the sound hood for an air flow entering the sound hood to be constantly refracted and/or reflected therein. The microporous plate is disposed inside the expanding cavity, and a plurality of through holes are formed in the microporous plate such that the air flow entering the expanding cavity exits the expanding cavity after passing through the through holes of the microporous plate. In one embodiment, the plurality of through holes may be distributed in the microporous plate uniformly or in an array.

Figure 2:
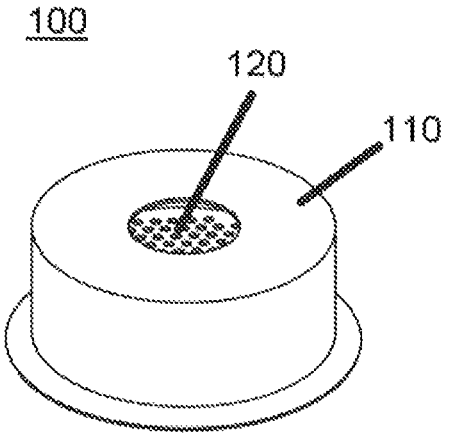
FIG. 2 is an overall structure schematic view of a muffler device according to an embodiment of the present disclosure.
Figure 3:
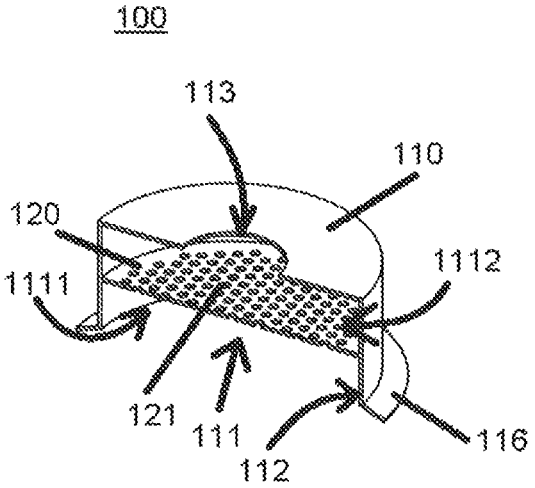
FIG. 3 is a cross-sectional structure schematic view of the muffler device shown in FIG. 2.
Figure 4:
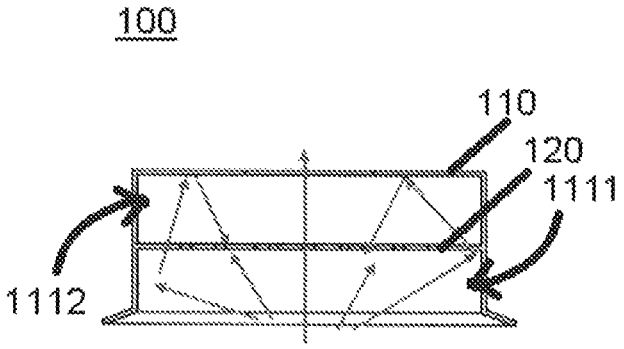
FIG. 4 is a schematic view showing an acoustic wave path of the muffler device shown in FIG. 3.

FIG. 2 is an overall structure schematic view of a muffler device according to an embodiment of the present disclosure; FIG. 3 is a cross-sectional structure schematic view of the muffler device shown in FIG. 2; and FIG. 4 is a schematic view showing an acoustic wave path of the muffler device shown in FIG. 3. As shown in FIGS. 2 and 3, the muffler device 100 includes a sound hood 110 and a microporous plate 120. The microporous plate 120 includes a plurality of through holes 121 formed thereon. An expanding cavity 111 is defined inside the sound hood 110, and the microporous plate 120 is disposed inside the expanding cavity 111 such that the air flow entering the expanding cavity 111 exits the expanding cavity 111 after passing through the through holes 121 of the microporous plate 120. The expanding cavity 111 is divided by the microporous plate 120 into the first cavity body 1111 and the second cavity body 1112. The sound hood 110 has an acoustic wave inlet 112 and an acoustic wave outlet 113. The acoustic wave inlet 112 and the acoustic wave outlet 113 are in communication with each other via the expanding cavity 111.

Specifically, in the embodiment shown in FIGS. 2 and 3, the microporous plate 120 is in a form of a flat plate; the first cavity body 1111 is directly in communication with the acoustic wave inlet 112, the second cavity body 1112 is directly in communication with the acoustic wave outlet 113, and the first cavity body 1111 and the second cavity body 1112 is in communication with each other via the through holes 121 of the microporous plate 120. As shown in FIG. 4 (in which the straight line with a small solid arrow indicates the propagation direction of the incident acoustic wave), the incident acoustic wave enters the expanding cavity 111 from the acoustic wave inlet 112, and can be constantly refracted and/or reflect in the expanding cavity 111, so that the energy of the acoustic wave is substantially weakened. The incident acoustic wave and the reflected acoustic wave may cancel each other out especially when the phase difference between the incident acoustic wave and the reflected acoustic wave is 180 degree; at the same time, the microporous plate 120 can increase the acoustic resistance of incident acoustic waves and/or reflected acoustic waves, thereby further weakening the energy of the acoustic wave, which further reduces the pneumatic noise.

Figure 5:
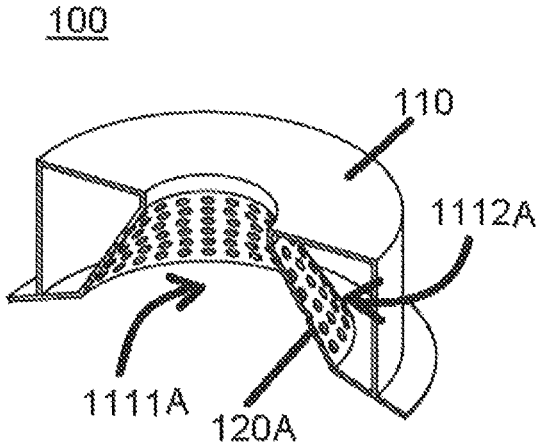
FIG. 5 is a cross-sectional structure schematic of a muffler device according to another embodiment of the present disclosure.
Figure 6:
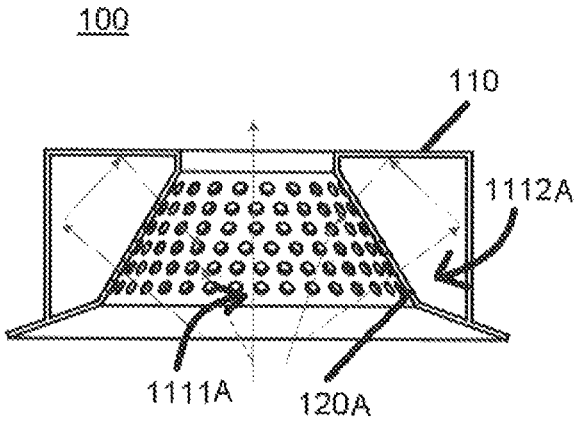
FIG. 6 is a schematic view showing an acoustic wave path of the muffler device shown in FIG. 5.

FIG. 5 is a cross-sectional structure schematic of a muffler device according to another embodiment of the present disclosure; and FIG. 6 is a schematic view showing an acoustic wave path of the muffler device shown in FIG. 5. Different from the embodiment shown in FIGS. 2 and 3, in the embodiment shown in FIG. 5, the microporous plate 120A is in a shape of a truncated cone; the first cavity body 1111A in the expanding cavity is directly in communication with the acoustic wave inlet 111 and the acoustic wave outlet 112, and the second cavity body 1112A in the expanding cavity is in communication with the first cavity body 1111A via the through holes of the microporous plate 120A. As shown in FIG. 6 (in which the straight line with a small solid arrow indicates the propagation direction of the incident acoustic wave), the microporous plate 120A in a shape of a truncated cone is used in the present embodiment, and the incident acoustic wave firstly passes through the through holes of the microporous plate 120A before entering the second cavity body 1112A so as to increase the acoustic resistance to the incident acoustic wave; then the incident acoustic wave enters the second cavity body 1112A to be constantly refracted and/or reflected, thereby achieving better silencing effect. It should be noted that there are no special restrictions on the specific cone angle and specific shape of the microporous plate in the shape of the truncated cone in the embodiment, as long as it is capable of facilitating realization of the sound reducing effect to the incident acoustic waves.

Figure 7:
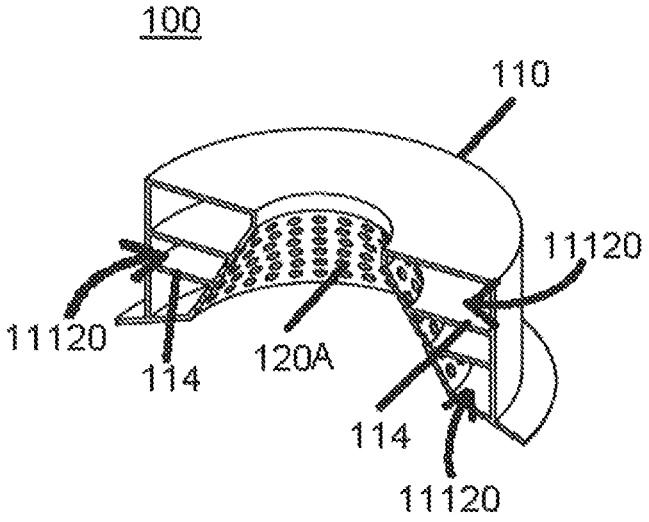
FIG. 7 is a cross-sectional structure schematic view of a muffler device according to yet another embodiment of the present disclosure.
Figure 8:
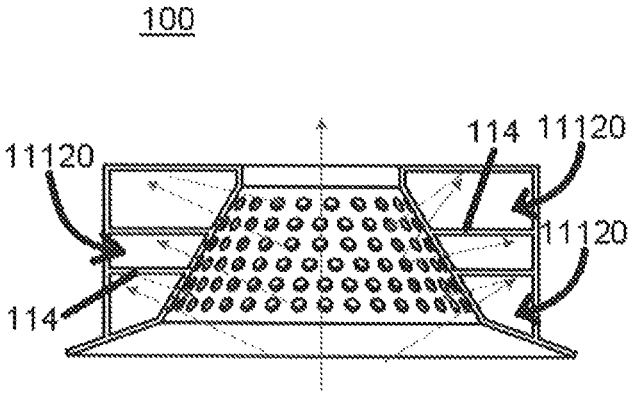
FIG. 8 is a schematic view showing an acoustic wave path of the muffler device shown in FIG. 7.

FIG. 7 is a cross-sectional structure schematic view of a muffler device according to yet still another embodiment of the present disclosure; FIG. 8 is a schematic view showing an acoustic wave path of the muffler device shown in FIG. 7. On the basis of the embodiment shown in FIG. 5, in the yet still another embodiment shown in FIG. 7, the second cavity body are further provided with two partition plates 114, and the second cavity body is divided into three second sub-cavity bodies 11120 by the partition plates 114. As shown in FIG. 8 (in which the straight line with a small solid arrow indicates the propagation direction of the incident acoustic wave), in this embodiment, the second cavity body is divided into three second sub-cavity bodies 11120 by the partition plates 114, which three second sub-cavity bodies 11120 are independent of each other. It is more advantageous for incident acoustic waves to be refracted and reflected in each of the second sub-cavity bodies 11120 after passing through the microporous plate in a shape of a truncated cone, thereby achieving a better sound reducing effect. It should be noted that there are two partition plates in the second cavity body in this figure. However, in other examples, the number of partition plates may be 1 or 3 or more, thereby dividing the second cavity body into at least two sub-cavity bodies. Therefore, there are no special restrictions on the specific cone angle and specific shape of the microporous plate in the shape of the truncated cone as well as the specific numbers of the partition plates and the sub-cavity body in this embodiment, as long as they are capable of facilitating realization of the sound reducing effect to the incident acoustic waves.

Figure 9:
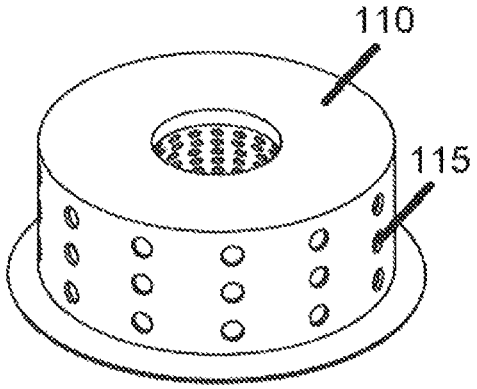
FIG. 9 is an overall structure schematic view of a muffler device according to yet still another embodiment of the present disclosure.
Figure 10:
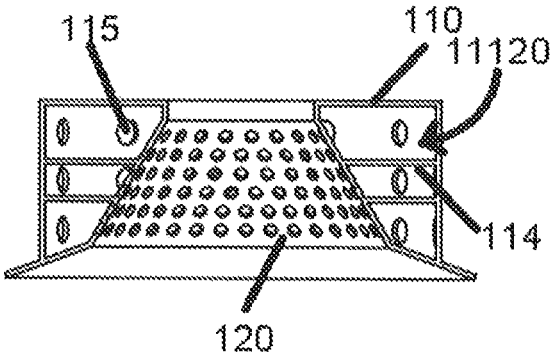
FIG. 10 is a cross-sectional structure schematic view of the muffler device shown in FIG. 9.

FIG. 9 is an overall structure schematic view of a muffler device according to yet still another embodiment of the present disclosure; and FIG. 10 is a cross-sectional structure schematic view of the muffler device shown in FIG. 9. On the basis of the embodiment shown in FIG. 7, in the yet still another embodiment of FIGS. 9 and 10, openings 115 are formed on the outer wall of the sound hood 110, the second sub-cavity bodies 11120 are in communication with the outside of the sound hood 110 via the openings 115. By forming openings 115 on the outer wall of the sound hood 110, the gas within the independent second sub-cavity bodies 11120 may quickly flow outside, thereby minimizing the adverse effect on the exhaust performance of the compressor, without affecting the sound reducing effect of the muffler device. It should be noted that the specific cone angle and specific shape of the microporous plate with truncated cone shape, the specific number of the partition plates and the sub-cavity bodies, as well as the number, diameter and shape of the openings are not particularly limited, as long as they are capable of facilitating better realization of the sound reducing effect to the incident acoustic waves.

Further, according to embodiments of the present disclosure, as shown in FIG. 3, the plurality of through holes 121 may be distributed on the microporous plate 120 uniformly or in an array, and each through hole 121 may a circular hole with a diameter preferably of about 0.5 mm-3 mm, more preferably of about 1 mm. However, in an embodiment not shown, the through holes may be in other shapes and sizes, and may be distributed on the microporous plate 120 in other distribution ways, as long as they are capable of facilitating realization of the sound reducing effect to the incident acoustic waves.

Further, according to embodiments of the present disclosure, as shown in FIG. 2, the sound hood 110 is in a shape of hollow cylinder, and the acoustic wave inlet 112 and the acoustic wave outlet 113 are respectively formed on two end surfaces of the sound hood 110, the size of the acoustic wave outlet 113 is designed to be adapted to the size of the exhaust port of the compressor, and the size of the acoustic wave inlet 112 is adapted to being assembled at the exhaust port of the compressor. The sound hood 110 further has a flange 116 (namely a ring flange in the illustrated embodiment) formed at the acoustic wave inlet 112 to facilitate mounting the muffler device to the exhaust port of the compressor by soldering or in a threaded manner.

It is known that the muffler device provided by the present disclosure may be applied to the exhaust port of the compressor, and in the muffler device, the incident acoustic wave may be constantly refracted and/or reflected in the expanding cavity, so that the energy of the acoustic wave is greatly weakened. The incident acoustic wave and the reflected acoustic wave may cancel out each other especially when the phase difference between the incident acoustic wave and the reflected acoustic wave is 180 degree; at the same time, the microporous plate may increase the acoustic resistance of incident acoustic waves and/or reflected acoustic waves, thereby further weakening the energy of the acoustic wave, which further reduces the pneumatic noise. In addition, the muffler device provided by the present disclosure is simple in structure and has a good silencing efficiency and a low cost. Further, the muffler device provided by the present disclosure may be applied to all types of compressors, such as a scroll compressor.

All technical languages as used herein are commonly used in the art unless otherwise indicated. The definitions given herein are conducive to certain terms used frequently in the context and are not intended to limit the scope of the disclosure.

Specific embodiments of the present disclosure illustrate the principles and their efficacy of the present disclosure, not for limiting the disclosure, and those skilled in the art will appreciate that any changes and improvements made to the present disclosure are within the scope of the present disclosure without departing from the spirit and scope of the present disclosure. The scope of the claims of the present disclosure shall be based on the scope of the application patent scope of the present disclosure.

What is claimed is:

1. A compressor, comprising:

a housing;

a compression assembly provided inside the housing;

an air inlet and an exhaust port provided in the housing; and a muffler device mounted at the exhaust port, the muffler device comprising:

a sound hood including an expanding cavity that is defined inside the sound hood, the sound hood further including an acoustic wave inlet and an acoustic wave outlet, the acoustic wave inlet and the acoustic wave outlet being communicated via the expanding cavity, and a microporous plate in a shape of a truncated cone, which is disposed inside the expanding cavity and divides the expanding cavity into a first cavity body and a second cavity body, and a plurality of through holes provided on the microporous plate such that a high-speed air flow that is discharged from the exhaust port and enters the expanding cavity exits the expanding cavity after passing through the plurality of through holes of the microporous plate, the high-speed air being accompanied by noisy acoustic waves, wherein the first cavity body is directly in communication with the acoustic wave inlet and the acoustic wave outlet, and the second cavity body is in communication with the first cavity body via the plurality of through holes of the microporous plate, wherein at least a portion of the microporous plate is aligned with the acoustic wave inlet in a direction that extends perpendicular to the acoustic wave inlet, wherein the expanding cavity and the shape of the microporous plate are configured to alter the direction of the air flow so that the noisy acoustic waves are constantly refracted and/or reflected in the second cavity body of the expanding cavity to make the phase difference between incident noisy acoustic waves and reflected noisy acoustic waves be 180 degrees so that the incident noisy acoustic waves and reflected noisy acoustic waves can cancel each other out; and wherein an outer wall of the sound hood is formed with secondary openings, and the second cavity body is in communication with the outside of the sound hood via the secondary openings.

2. The compressor according to claim 1, wherein the muffler device further comprises:

at least one partition plate, and the second cavity body is divided into at least two second sub-cavity bodies by the at least one partition plate.

3. The compressor according to claim 2, wherein the plurality of through holes of the microporous plate are distributed in an array, and each through hole is a circular hole with a diameter of 0.5 mm to 3 mm.

4. The compressor according to claim 2, wherein the sound hood is in a shape of a hollow cylinder, and the acoustic wave inlet and the acoustic wave outlet are respectively formed on two end surfaces of the sound hood in the shape of the hollow cylinder.

5. The compressor according to claim 2, wherein the sound hood further comprises:

a flange formed at the acoustic wave inlet.

6. The compressor according to claim 1, wherein the plurality of through holes of the microporous plate are distributed in an array, and each through hole is a circular hole with a diameter of 0.5 mm to 3 mm.

7. The compressor according to claim 1, wherein the sound hood is in a shape of a hollow cylinder, and the acoustic wave inlet and the acoustic wave outlet are respectively formed on two end surfaces of the sound hood in the shape of the hollow cylinder.

8. The compressor according to claim 1, wherein the sound hood further comprises:

a flange formed at the acoustic wave inlet.

9. The compressor according to claim 1, wherein the truncated cone shape has a first end and a second end, wherein the first end is larger than the second end, and wherein the acoustic wave inlet is arranged at or near the first end of the truncated cone and the acoustic wave outlet is arranged at or near the second end of the truncated cone.

10. A compressor, comprising:

a housing;

a compression assembly provided inside the housing;

an air inlet and an exhaust port provided in the housing; and a muffler device mounted at the exhaust port, the muffler device comprising:

a sound hood including an expanding cavity that is defined inside the sound hood, the sound hood further including an acoustic wave inlet and an acoustic wave outlet, the acoustic wave inlet and the acoustic wave outlet being communicated via the expanding cavity, and a microporous plate in a shape of a truncated cone, which is disposed inside the expanding cavity and divides the expanding cavity into a first cavity body and a second cavity body, and a plurality of through holes provided on the microporous plate such that a high-speed air flow that is discharged from the exhaust port and enters the expanding cavity exits the expanding cavity after passing through the plurality of through holes of the microporous plate, the high-speed air being accompanied by noisy acoustic waves, wherein the first cavity body is directly in communication with the acoustic wave inlet and the acoustic wave outlet, and the second cavity body is in communication with the first cavity body via the plurality of through holes of the microporous plate, wherein the truncated cone shape has a first end and a second end, wherein at least one of the first end and the second end is smaller than at least one of the acoustic wave inlet and the acoustic wave outlet, and wherein the expanding cavity and the shape of the microporous plate are configured to alter the direction of the air flow so that the noisy acoustic waves are constantly refracted and/or reflected in the second cavity body of the expanding cavity to make the phase difference between incident noisy acoustic waves and reflected noisy acoustic waves be 180 degrees so that the incident noisy acoustic waves and reflected noisy acoustic waves can cancel each other out;

wherein an outer wall of the sound hood is formed with secondary openings, and the second cavity body is in communication with the outside of the sound hood via the secondary openings.

11. The compressor according to claim 10, wherein the muffler device further comprises:

at least one partition plate, and the second cavity body is divided into at least two second sub-cavity bodies by the at least one partition plate.

12. The compressor according to claim 10, wherein the plurality of through holes of the microporous plate are distributed in an array, and each through hole is a circular hole with a diameter of 0.5 mm to 3 mm.

13. The compressor according to claim 10, wherein the sound hood is in a shape of a hollow cylinder, and the acoustic wave inlet and the acoustic wave outlet are respectively formed on two end surfaces of the sound hood in the shape of the hollow cylinder.

14. The compressor according to claim 10, wherein the sound hood further comprises:

a flange formed at the acoustic wave inlet.

15. A compressor, comprising:

a housing;

a compression assembly provided inside the housing;

an air inlet and an exhaust port provided in the housing; and a muffler device mounted at the exhaust port, the muffler device comprising:

a sound hood including an expanding cavity that is defined inside the sound hood, the sound hood further including an acoustic wave inlet and an acoustic wave outlet, the acoustic wave inlet and the acoustic wave outlet being communicated via the expanding cavity, and a microporous plate in a shape of a truncated cone, which is disposed inside the expanding cavity and divides the expanding cavity into a first cavity body and a second cavity body, and a plurality of through holes provided on the microporous plate such that a high-speed air flow that is discharged from the exhaust port and enters the expanding cavity exits the expanding cavity after passing through the plurality of through holes of the microporous plate, the high-speed air being accompanied by noisy acoustic waves, wherein the first cavity body is directly in communication with the acoustic wave inlet and the acoustic wave outlet, and the second cavity body is in communication with the first cavity body via the plurality of through holes of the microporous plate, wherein an outer wall of the sound hood is formed with secondary openings, and wherein the second cavity body is in communication with the outside of the sound hood via the secondary openings, and wherein the expanding cavity and the shape of the microporous plate are configured to alter the direction of the air flow so that the noisy acoustic waves are constantly refracted and/or reflected in the second cavity body of the expanding cavity to make the phase difference between incident noisy acoustic waves and reflected noisy acoustic waves be 180 degrees so that the incident noisy acoustic waves and reflected noisy acoustic waves can cancel each other out.

16. The compressor according to claim 15, wherein the muffler device further comprises:

at least one partition plate, and the second cavity body is divided into at least two second sub-cavity bodies by the at least one partition plate.

17. The compressor according to claim 15, wherein the plurality of through holes of the microporous plate are distributed in an array, and each through hole is a circular hole with a diameter of 0.5 mm to 3 mm.

18. The compressor according to claim 15, wherein the sound hood is in a shape of a hollow cylinder, and the acoustic wave inlet and the acoustic wave outlet are respectively formed on two end surfaces of the sound hood in the shape of the hollow cylinder.

19. The compressor according to claim 15, wherein the sound hood further comprises:

a flange formed at the acoustic wave inlet.

* * * * *